US010542349B2

(12) United States Patent
Ye

(10) Patent No.: US 10,542,349 B2
(45) Date of Patent: Jan. 21, 2020

(54) ELECTRONIC DEVICE AND MICROPHONE STRUCTURE WITH ENHANCED BACK CAVITY

(71) Applicants: Zilltek Technology (Shanghai) Corp., Shanghai (CN); Zilltek Technology Corp., Hsinchu (TW)

(72) Inventor: Jinghua Ye, Shanghai (CN)

(73) Assignees: Zilltek Technology (Shanghai) Corp., Shanghai (CN); Zilltek Technology Corp., Hsinchu (TW)

( * ) Notice: Subject to any disclaimer, the term of this patent is extended or adjusted under 35 U.S.C. 154(b) by 0 days.

(21) Appl. No.: 15/992,858

(22) Filed: May 30, 2018

(65) Prior Publication Data

US 2019/0182604 A1 Jun. 13, 2019

(30) Foreign Application Priority Data

Dec. 7, 2017 (CN) ..... 2017 1 1286048

(51) Int. Cl.
*H04R 19/04* (2006.01)
*H04R 1/08* (2006.01)
(Continued)

(52) U.S. Cl.
CPC ..... *H04R 19/04* (2013.01); *H04R 1/06* (2013.01); *H04R 1/08* (2013.01); *H04R 31/00* (2013.01); *H04R 2201/003* (2013.01)

(58) Field of Classification Search
CPC .... B81B 2201/0257; B81B 2201/0264; B81B 2203/0127; B81B 3/0021;
(Continued)

(56) References Cited

U.S. PATENT DOCUMENTS

2004/0145054 A1* 7/2004 Bang ..... H01L 23/49816 257/737
2014/0084394 A1* 3/2014 Je ..... B81B 7/0054 257/416
2015/0014796 A1* 1/2015 Dehe ..... B81B 7/0016 257/416

FOREIGN PATENT DOCUMENTS

CN 202931547 U * 5/2013

* cited by examiner

*Primary Examiner* — Curtis A Kuntz
*Assistant Examiner* — Julie X Dang
(74) *Attorney, Agent, or Firm* — The Dobrusin Law Firm, P.C.; Bryan S. Lemanski

(57) ABSTRACT

The invention relates to the field of micro-electromechanical technology, and more particularly, to a microphone structure with an enhanced back cavity and an electronic device, comprising: a first layer plate, an groove is configured on the first layer plate, wherein an acoustic sensor is installed above the groove by means of a support, and the acoustic sensor is provided with a back cavity facing towards the support, and a through-hole for penetrating through the back cavity and the groove is provided on the support; a second layer plate, covering the first layer plate, wherein an acoustic through-hole is configured on the second layer plate; wherein, the first layer plate and second layer plate form a microphone acoustic cavity. The beneficial effects of the technical solutions of the invention are as follows: a microphone structure with an enhanced back cavity and an electronic device is disclosed, which boasts low cost and simple manufacturing process, wherein the volume of the back cavity is effectively enlarged, the sensitivity inside of the microphone structure is enhanced, and the acoustic performance of the microphone structure is improved, such that the tone quality received by the electronic product becomes better.

6 Claims, 1 Drawing Sheet

(51) Int. Cl.
*H04R 31/00* (2006.01)
*H04R 1/06* (2006.01)

(58) Field of Classification Search
CPC ..... B81B 2201/0271; B81B 2207/012; B81B 2207/092; B81B 3/0094; B81B 7/0016; B81B 7/0061; B81B 2201/018; B81B 2201/0235; B81B 2203/0118; B81B 2207/015; H04R 1/04; H04R 19/016; H04R 1/08; H04R 1/222; H04R 1/2892; H04R 2225/49; H04R 23/00; H04R 2410/03; H04R 31/003; H04R 3/00
USPC ..... 257/416, 414, 690; 381/173, 175
See application file for complete search history.

ELECTRONIC DEVICE AND MICROPHONE STRUCTURE WITH ENHANCED BACK CAVITY

BACKGROUND OF THE INVENTION

1. Field of the Invention

The invention relates to the field of micro-electromechanical technology, and more particularly, to a microphone structure with an enhanced back cavity and an electronic device.

2. Description of the Related Art

With the development of mobile multimedia technology, electronic products tend to become miniature and integrated. For the electronic products in the electroacoustic field, microphone is used to convert an acoustic signal into an electrical signal. Over the years, the microphone structure is widely used in mobile phones, headphones, laptops, video cameras and other electronic devices.

The electronic device is typically surrounded by a complex electric field environment during its operation, and therefore is often subject to the electrical interference from outside. In addition, in the case of reduced microphone structure and extremely small space of back cavity formed in the interior of the microphone structure, that is, in such a limited space, on one hand, the sensitivity of the interior of the microphone structure decreases, and thus the tone quality of the sound received by the electronic product is declined, on the other hand, the manufacturing process is relatively complex and the cost is relatively high, therefore, it has become a hot issue in current research to improve the acoustic performance of the microphone structure.

SUMMARY OF THE INVENTION

Given that the foregoing problems exist in the prior art, the present invention provides a microphone structure with an enhanced back cavity and an electronic device intended to improve the acoustic performance of the microphone structure.

Detailed technical solutions are as follows:

a microphone structure with an enhanced back cavity, comprising:

a first layer plate, an groove being configured on the first layer plate, an acoustic sensor being installed in the area above the groove by means of a support, the acoustic sensor being provided with a back cavity facing towards the support, and a through-hole for penetrating through the back cavity and the groove being provided on the support;

a second layer plate, covering the first layer plate, wherein the second layer plate comprises an acoustic through-hole;

wherein, the first layer plate and second layer plate form a microphone acoustic cavity.

Preferably, a plurality of through-holes are configured on the support.

Preferably, the first layer plate is further connected to a circuit chip.

Preferably, the first layer plate is a printed circuit board and the printed circuit board is provided with a pad at its bottom.

Preferably, the acoustic sensor is connected to the circuit chip via lead wires.

Preferably, the groove is obtained by an etching process.

Preferably, the support is a metal sheet.

An electronic device comprises the abovementioned microphone structure with the enhanced back cavity.

The beneficial effects of the technical solutions of the invention are as follows: a microphone structure with an enhanced back cavity and an electronic device is disclosed, which boasts low cost and simple manufacturing process, wherein the volume of the back cavity is effectively enlarged, the sensitivity of the interior of the microphone structure is enhanced, and the acoustic performance of the microphone structure is improved, such that the tone quality of the sound received by the electronic product becomes better.

BRIEF DESCRIPTION OF THE DRAWINGS

The accompanying drawings, together with the specification, illustrate exemplary embodiments of the present disclosure, and, together with the description, serve to explain the principles of the present invention.

DETAILED DESCRIPTION

Figure 1:
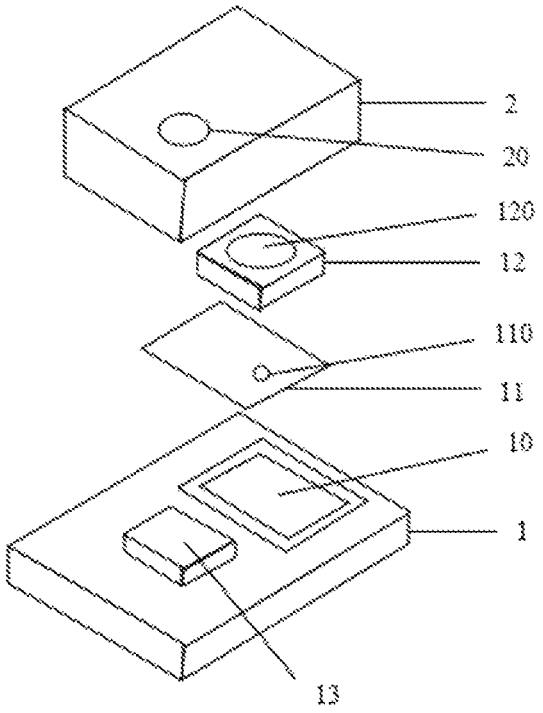
FIG. 1 is an overall structure diagram of a microphone structure with an enhanced back cavity according to the present invention.

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the term "plurality" means a number greater than one.

Hereinafter, certain exemplary embodiments according to the present disclosure will be described with reference to the accompanying drawings.

The present invention comprises a microphone structure with an enhanced back cavity, comprising:

a first layer plate 1, an groove 10 being configured on the first layer plate 1, an acoustic sensor 12 being installed in the area above the groove 10 by a support 11, the acoustic sensor 12 being provided with a back cavity 120 facing towards the support 11, and a through-hole 110 for penetrating through the back cavity 120 and the groove 10 being provided on the support 11;

a second layer plate 2, covering the first layer plate 1, wherein an acoustic through-hole 20 is configured on the second layer plate 2;

wherein, the first layer plate 1 and second layer plate 2 form a microphone acoustic cavity 3.

In the above microphone structure with the enhanced back cavity, as shown in FIG. 1, the acoustic sensor 10 is used to convert an acoustic signal into a voltage signal first, and the circuit chip 13 performs signal processing and analog-to-digital conversion to the output voltage signal, and finally a digital signal is acquired.

Further, a groove 10 is configured on the first layer plate 1, and the groove 10 is obtained by an etching process, and the acoustic sensor 12 is provided with a back cavity 120, penetration through the back cavity 120 and the groove 10 is achieved through the through-hole 110. Moreover, it boasts low cost and simple manufacturing process, wherein the volume of the back cavity 120 is effectively enlarged, the sensitivity of the interior of the microphone structure is enhanced, and the acoustic performance of the microphone structure is improved; moreover, the first layer plate 1 and second layer plate 2 form a microphone acoustic cavity 3, and the acoustic through-hole 20 makes it possible for the interior of the microphone acoustic cavity 3 to communicate with the outside world, whereby voice signal is transmitted to the outside world, such that the tone quality of the sound received by the electronic product becomes better.

In a preferred embodiment, wherein a plurality of through-holes 110 may be configured on the support 11.

Figure 2:
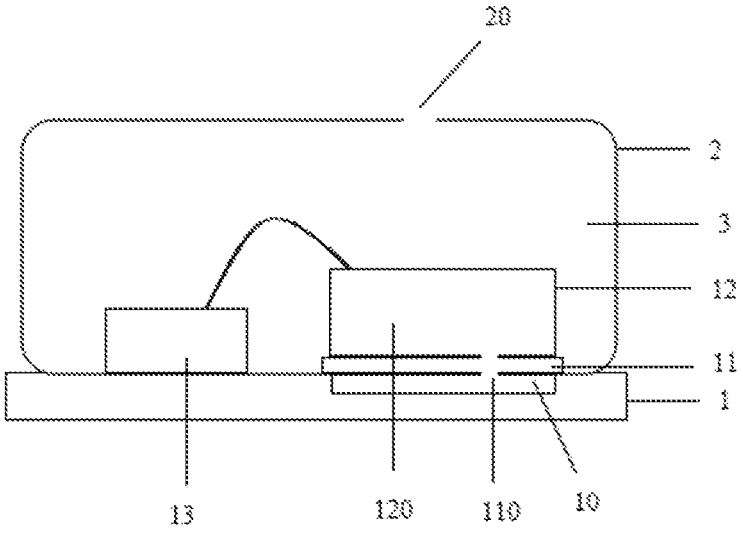
FIG. 2 is a front view of a microphone structure with an enhanced back cavity in an implementation of the present invention.

Specifically, in this embodiment, as shown in FIG. 2, a groove 10 is configured on the first layer plate 1, an acoustic sensor 12 is installed in the area above the groove 10 by means of a support 11, and the acoustic sensor 12 is provided with a back cavity 120 facing towards the support 11, and a through-hole 110 for penetrating through the back cavity 120 and the groove 10 is provided on the support 11. Provision of the groove 10 makes it possible to enlarge the volume of the back cavity 120, and to further improve the acoustic performance of the microphone, such that sound received outside will not be distorted, and the acoustic performance of the microphone can be improved without changing space occupied by the microphone structure.

In a preferred embodiment, the opening of the groove 10 is larger than the occupied area of the acoustic sensor 12, and the support 11 is disposed above the groove 10, and the volume of the back cavity 120 is increased at the greatest extent.

In a preferred embodiment, wherein the first layer plate 1 is further connected to a circuit chip 13.

In a preferred embodiment, wherein the first layer plate 1 is a printed circuit board and the printed circuit board is provided with a pad at its bottom.

In a preferred embodiment, wherein the acoustic sensor 12 is connected to the circuit chip 13 via lead wires.

In a preferred embodiment, wherein the groove 10 is obtained through an etching process. The groove 10 is processed by microelectronic technique, which makes the consistency of the groove is good.

In a preferred embodiment, wherein the support 11 is a metal sheet. The support 11 is deposited on the groove by bonding or by a semiconductor process, and the metal sheet selected preferably has a better supporting characteristics.

An electronic device, comprising the above microphone structure with the enhanced back cavity.

Specifically, in this embodiment, a microphone structure with an enhanced back cavity is used in the electronic device, wherein a groove 10 is configured on the first layer plate 1, and penetration through the back cavity 120 and the groove 10 is achieved through the through-hole 110, thus, it boasts low cost and simple manufacturing process, wherein the volume of the back cavity 120 is effectively enlarged, the sensitivity of the interior of the microphone structure is enhanced, and the acoustic performance of the microphone structure is improved; moreover, the acoustic through-hole 20 makes it possible for the interior of the microphone acoustic cavity 3 to communicate with the outside world. In doing so, the acoustic performance of the microphone is improved without changing space occupied by the microphone structure.

Further, the acoustic performance of the microphone structure with the enhanced back cavity is improved, such that when the electronic device is used in a complex electric field environment, the possibility that the electronic device is subject to the electrical interference from outside is reduced, and the tone quality of the sound received by the electronic device becomes better.

It should be noted that the electronic device is not limited to mobile or non-mobile electronic devices, which will not be repeated herein.

The above descriptions are only the preferred embodiments of the invention, not thus limiting the embodiments and scope of the invention. Those skilled in the art should be able to realize that the schemes obtained from the content of specification and drawings of the invention are within the scope of the invention.

What is claimed is:

1. A microphone structure with an enhanced back cavity, comprising:

a first layer plate;

a groove obtained by an etching process, the groove being configured on the first layer plate;

an acoustic sensor being installed above the groove by a support that is a metal sheet, the acoustic sensor being provided with a back cavity facing towards the support, wherein the support includes a plurality of through-holes for penetrating through the back cavity and the groove; and a second layer plate covering the first layer plate, wherein the second layer plate comprises an acoustic through-hole, wherein the first layer plate and the second layer plate form a microphone acoustic cavity; and wherein the support is deposited on the groove by a semiconductor process.

2. The microphone structure with the enhanced back cavity of claim 1, wherein the first layer plate is further connected to a circuit chip.

3. The microphone structure with the enhanced back cavity of claim 1, wherein the first layer plate is a printed circuit board and the printed circuit board is provided with a pad at its bottom.

4. The microphone structure with the enhanced back cavity of claim 2, wherein the acoustic sensor is connected to the circuit chip via lead wires.

5. An electronic device comprising the microphone structure with the enhanced back cavity of claim 1.

6. The microphone structure with the enhanced back cavity of claim 1, wherein the groove is large than an occupied area of the acoustic sensor.

* * * * *